US005451276A

United States Patent [19]

Junius

[11] Patent Number: 5,451,276

[45] Date of Patent: Sep. 19, 1995

[54] PROCESS FOR PRODUCING A SKI EDGE

[75] Inventor: Hans-Toni Junius, Iserlohn, Germany

[73] Assignee: C.D. Walzholz Produktions-Gesellschaft m.b.H., Hagen, Germany

[21] Appl. No.: 199,247

[22] PCT Filed: Aug. 26, 1992

[86] PCT No.: PCT/EP92/01958

§ 371 Date: May 10, 1994

§ 102(e) Date: May 10, 1994

[87] PCT Pub. No.: WO/93/04742

PCT Pub. Date: Mar. 18, 1993

[30] Foreign Application Priority Data

Aug. 28, 1991 [DE] Germany ..... 41 28 410.0
Jun. 2, 1992 [DE] Germany ..... 42 18 099.6

[51] Int. Cl.[6] ..... A62C 5/048; C21D 8/00

[52] U.S. Cl. ..... 148/632; 148/641; 148/663; 280/608

[58] Field of Search ..... 148/624, 632, 641, 663; 280/608

[56] References Cited

U.S. PATENT DOCUMENTS 3,508,978 4/1970 Shuin ..... 148/624
4,818,839 4/1989 Chastain ..... 280/608
4,987,282 1/1991 Chastain ..... 280/608
5,144,109 9/1992 Klingel ..... 280/608
5,204,987 4/1993 Klingel ..... 280/608
5,327,634 7/1994 Gagneux ..... 280/608

FOREIGN PATENT DOCUMENTS 031399 7/1981 European Pat. Off. .
124501 11/1984 European Pat. Off. .
1289011 2/1962 France .
2204270 8/1972 Germany .

*Primary Examiner*—David A. Simmons
*Assistant Examiner*—Sikyin Ip
*Attorney, Agent, or Firm*—Collard & Roe

[57] ABSTRACT

A process is disclosed for producing a ski edge made of quenched and subsequently tempered steel having a head (2) that comprises the running surface and a flank (4) that projects into the body of the ski. The profiled edge (1) is at first rolled, then quenched and subsequently tempered over its whole cross-section. Afterwards, the flank (4) is partially tempered and provided in a separate operation with punched out openings. In order to obtain with this process a totally straight ski edge, the deviation in Rockwell hardness, seen in the direction of the cross-section and length of the profiled edge is set at less than 2° HRC during quenching and subsequent tempering of the whole profiled edge. The warming-up temperature and duration during partial warming-up of the edge are the same over the whole length of the profile edge and the profiled edge is subjected to a constant bending strain before being punched.

4 Claims, 4 Drawing Sheets

PROCESS FOR PRODUCING A SKI EDGE

The invention relates to a process for producing a ski edge made of quenched and tempered steel, which edge has a head having the running surface, and a flank projecting into the body of the ski, said flank being designed thinner than the head and being provided across its length with a great number of punched recesses and/or openings, with the subsequently specified successive process steps:

(a) Rolling or drawing of the profiled edge;

(b) Quenching and tempering of the entire profiled edge by heating to the hardening temperature and subsequent tempering;

(c) Partial heating of the flank to a temperature higher than the tempering temperature with simultaneous cooling of the head;

(d) Punching of the recesses and/or openings in the flank.

A process of the type specified above is known from DE-OS 22 04 270. Ski edges manufactured according to said process have the advantage, on the one hand, that the head is very hard across the entire cross section due to formation of a martensitic structure, so that a long useful life of the ski edge is obtained without resharpening. On the other hand, due to the partial heating, the flank is returned to a substantially pearlitic structure, so that said flank is relatively soft and ductile and, accordingly, can be worked by punching with little tool wear.

Even though the known process offers the above-discussed advantages, it has not been possible to introduce it in practical life. Essentially, this has to be attributed to the fact that the ski edge so produced does not extend in a straight line, but is curved in various ways in the main plane of expanse. Attempts to avoid such unavoidably occurring curvatures, which are also referred to as saber deviations, have failed in the past on account of the fact that the occurring radii of curvature highly differ across the length of the profiled edge, so that it is practically impossible to adjust in the bending device the correct bending deformation.

The problem of the invention is to further develop the process of the type specified above in such a way that the ski edge produced according to said process extends in a completely straight line.

For solving said problem, the invention proposes on the basis of the process of the type specified above that during the quenching and tempering of the entire profiled edge, the deviation in the Rockwell hardness seen in the direction of the cross section and length of the profiled edge is adjusted to less than 2° HRC; that the heating temperature and the duration of heating during the partial heating of the flank are kept constant across the length of the profiled edge; and that after the partial heating and prior to the punching, the profiled edge is subjected to a constant bending deformation, in connection with which the flank is stretched by a constant amount.

The invention is based on the finding that the unavoidably occurring saber deviations are substantially the consequence of changes in volume, which occur when the martensitic structure changes into a ferritic/pearlitic structure. The change of a carbon steel from a martensitic to a ferritic/pearlitic structure results in a volume contraction which, in the present case necessarily leads to pronounced saber formation because the after-treatment on the profiled edge takes place only on one side within the zone of the flank. Now, if it is assured through a suitable heat treatment that during quenching and tempering of the entire profiled edge, the deviations in the Rockwell hardness, i.e., in the formation of martensite, are minor seen in the direction across the cross section and the length of the profiled edge, on the one hand, and the heating temperature and the duration of heating, i.e., the formation of pearlite, are constant to the greatest possible degree during the partial heating of the flank across the length of the profiled edge, on the other hand, a uniform saber deviation is obtained across the length of the profiled edge, which deviation can be cancelled again during a subsequent bending deformation in a simple manner by a uniform stretching of the flank of the profiled edge.

The highly uniform formation of martensite in the profiled edge required according to the invention prior to the partial heating can be achieved, for example by carrying out during the quenching and tempering of the entire profiled edge a multi-step continuous quenching and tempering, in which the profiled edge is first abruptly cooled in a continuous metal bath to a temperature just above the martensite starting temperature (Ms), a change of the structure of the austenitic structure formed during the abrupt cooling into the martensitic structure is subsequently carried out with gradual cooling under an air shower, and a tempering treatment is finally carried out under protective gas. As opposed to the conventionally used oil quenching, the multi-step quenching and tempering as explained above leads to a highly uniform martensitic structure that is free of inner stresses to the highest possible degree. The metal bath quenching and the tempering under protective gas have the effect that phenomena of oxidation on the surfaces of the profile are avoided. The latter is important for the subsequent uniform heating of the flank of the profile, which would be hindered by oxidation layers.

Usefully, the above-specified abrupt cooling takes place in a lead-bismuth continuous bath at a constant temperature of particularly 350° C.

A ski edge of particularly high quality that can be punched with low tool wear is obtained if the quenching and tempering of the entire ski edge takes place to a Rockwell hardness of 50° to 60° HRC, and if the hardness of the flank is reduced by partial heating to 30° to 40° HRC.

BRIEF DESCRIPTION OF DRAWING

An example of execution of the invention is explained in greater detail in the following on the basis of the drawing, in which:

In FIGS. 1 to 4, the profiled edge is in each case denoted as a whole by the reference numeral 1. It consists of a head 2, which has the running surface 3, and of a flank 4, which is thinner than the head 2, and which serves for anchoring the profiled edge 1 in the body of the ski.

FIGS. 2 and 4 show that the flank 4 is provided with the punched recesses 5 (FIG. 2) or openings 6 (FIG. 4), which serve for superior interlocking and anchoring when the profiled edge 1 is secured in the body of the ski. In deviation of the exemplified embodiments shown, the recesses 5 and openings 6 may have a different shape.

The entire profiled edge 1 consists of a temperable steel, which, by the process according to the invention, is hardened within the range of the head 2 across the entire volume of the latter to a high hardness, for example to a Rockwell hardness of 50° to 60° HRC, whereas the flank 4 is reduced in hardness to, for example 30° to 40° HRC by additional partial tempering.

Figure 2:
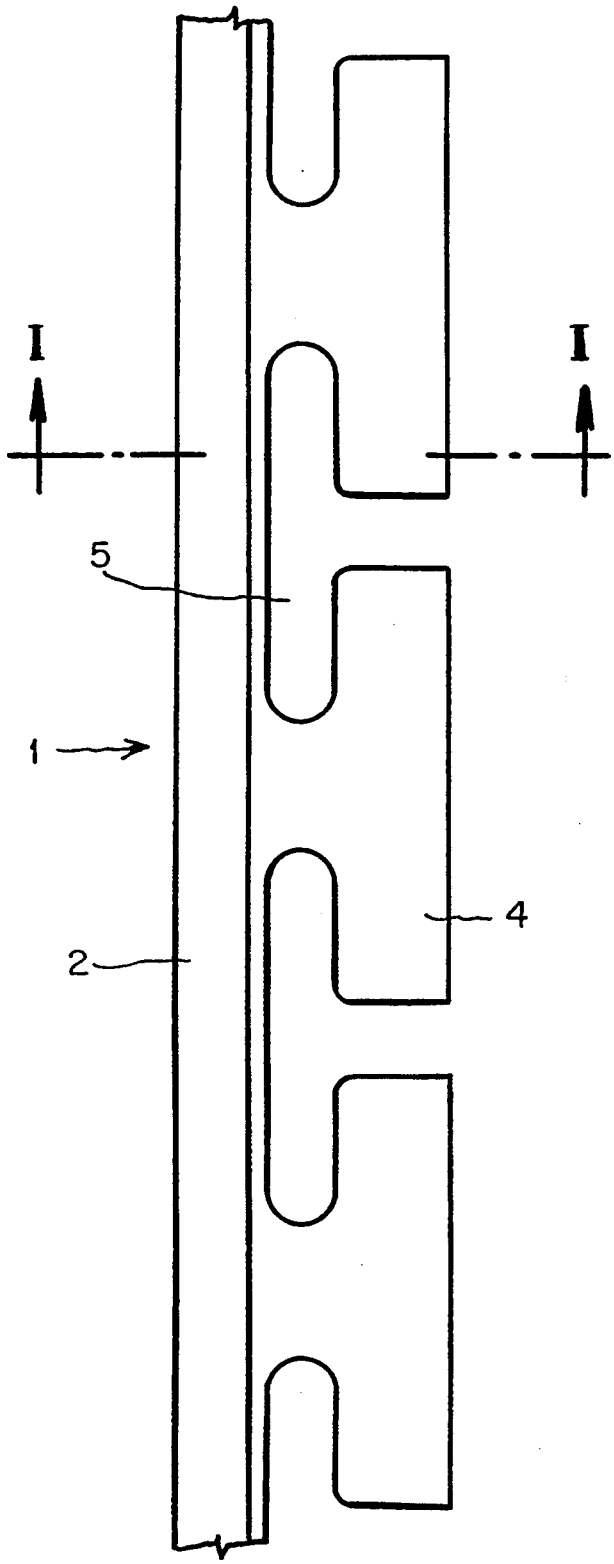
FIG. 2 shows a top view of FIG. 1.
Figure 1:
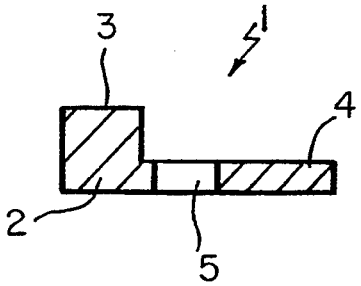
FIG. 1 shows a cross section through a punched profiled edge as a first embodiment.
Figure 4:
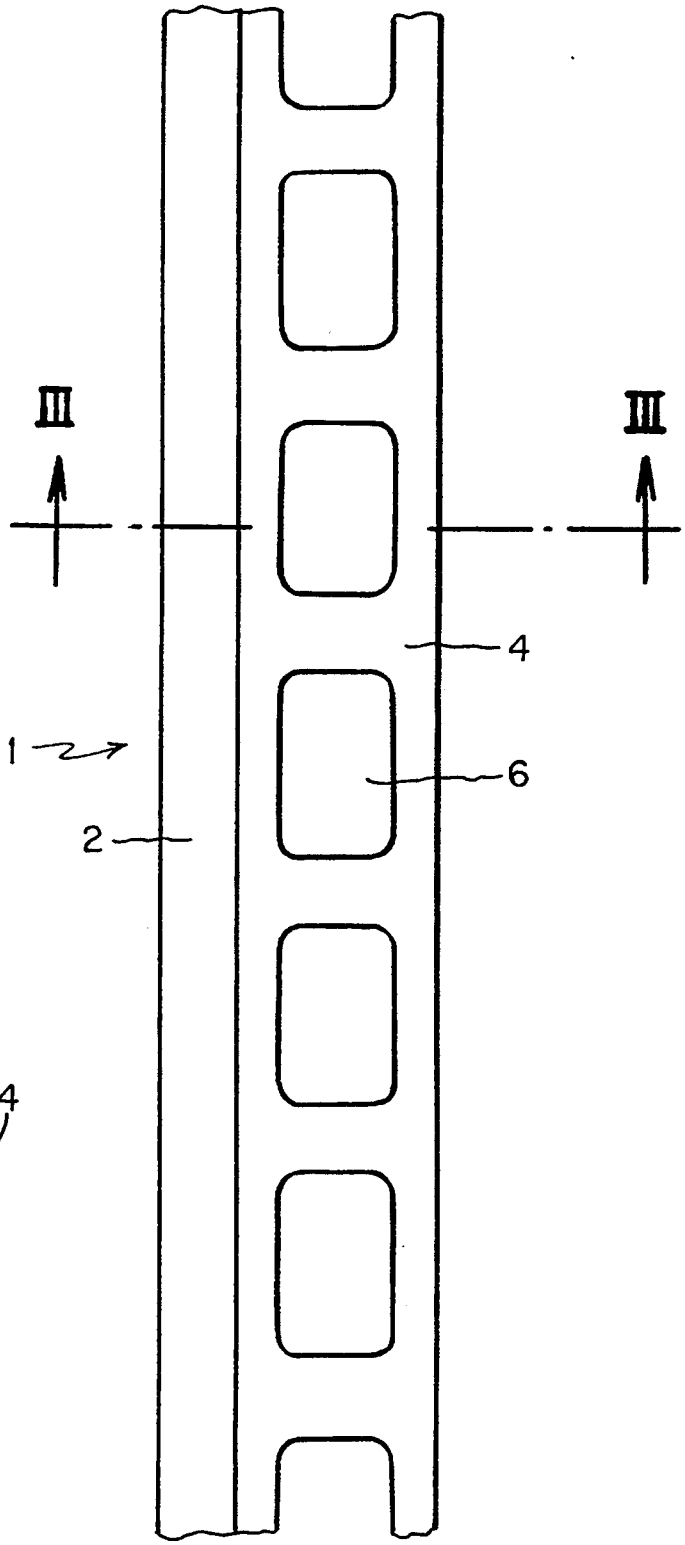
FIG. 4 shows of top view of FIG. 3.
Figure 3:
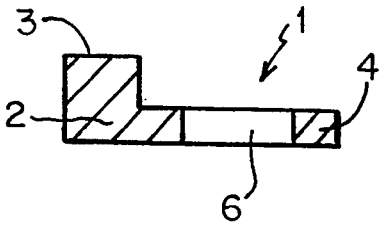
FIG. 3 shows a cross section through a punched profiled edge as a second embodiment.
Figure 5:
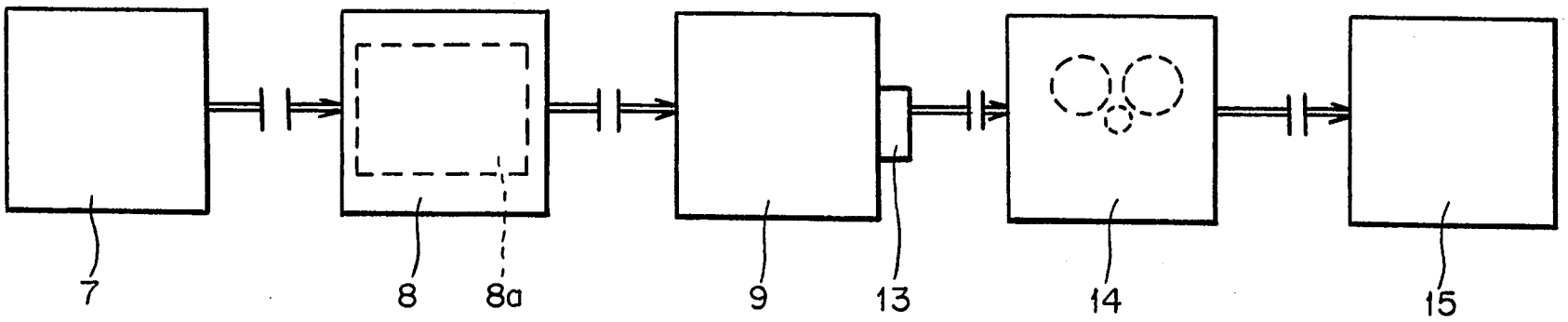
FIG. 5 shows schematically the sequence of the process according to the invention.
Figure 6:
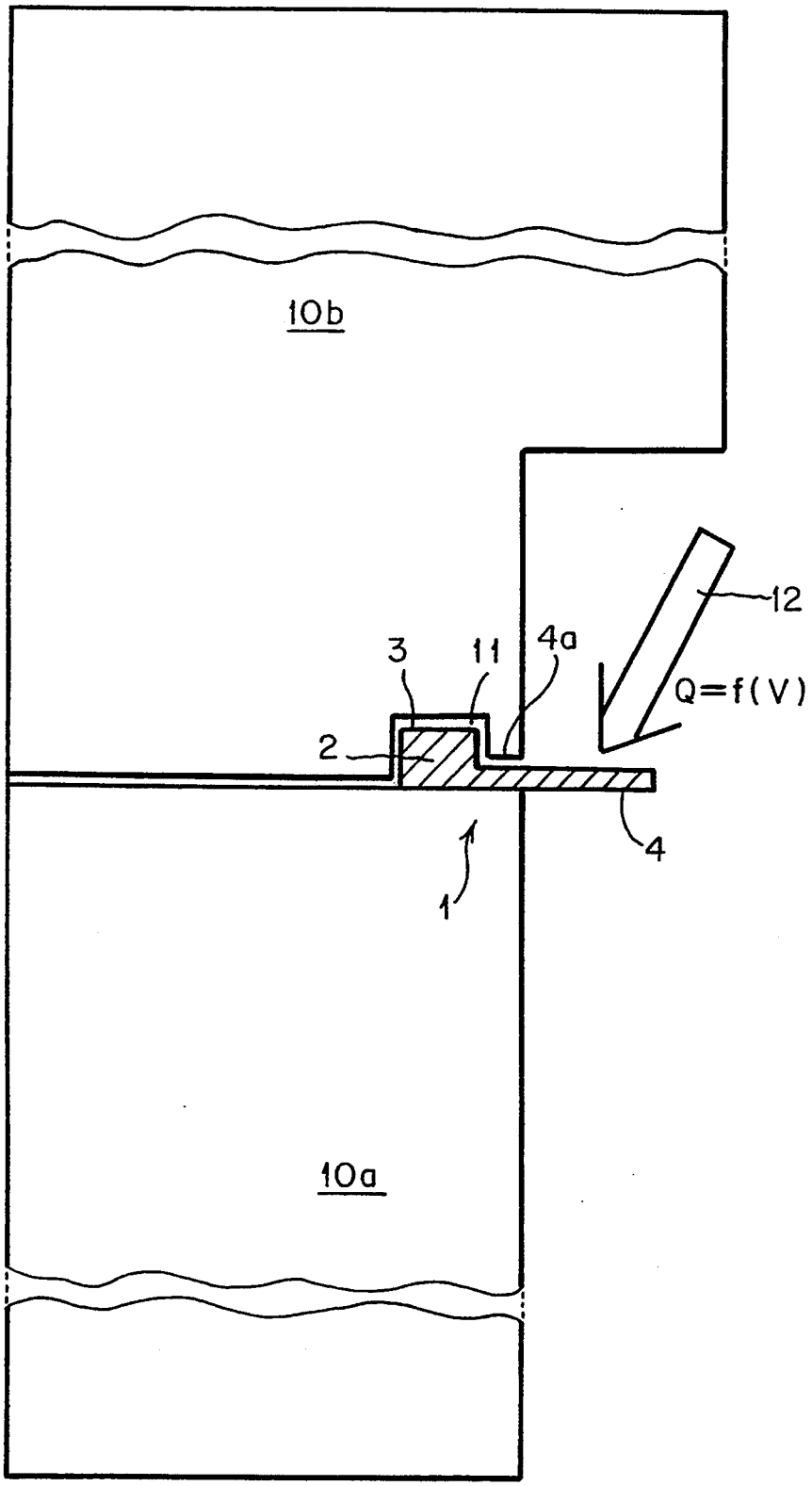
FIG. 6 is a schematic view of the additional continuous tempering device transversely to the processing direction.

The device shown in FIGS. 5 and 6 for carrying out the process according to the invention consists of a profile rolling mill 7, or a suitable profile drawing mill, in which the profiled edge 1 continuously receives the correct profiled shape. Subsequently, the profiled edge 1 is passed through a quenching and tempering plant 8, in which the profiled edge 1 is uniformly quenched and tempered across its entire cross section by heating to the above-critical temperature and subsequent quenching and tempering, namely to a relatively high hardness conforming to the final hardness of the head 2. Quenching in the quenching and tempering plant 8 is carried out in a continuous metal bath containing a liquid lead-bismuth melt of a constant temperature, preferably of about 350° C. Said temperature is still just above the martensite starting temperature (Ms). During the abrupt cooling process, a substantially austenitic structure is formed in the profiled edge 4. Subsequently, the profiled edge is gradually cooled under an air shower, whereby the austenitic structure formed during abrupt cooling is changed into a martensitic structure, which is homogeneous to the greatest possible degree. Thereafter, the profiled edge 1 is tempered under protective gas to a relatively low tempering temperature in order to exactly adjust the desired material properties. With the above-specified multi-step quenching and tempering process, uniform hardness is obtained to the greatest possible extent across the cross section and the length of the profiled edge 1. The deviations in Rockwell hardness across the cross section and length of the profiled edge 1 only come to 2° HRC at the most.

Subsequently, the profiled edge 1, which is uniformly hardened across its entire volume, passes through a continuous plant 9 for additional partial tempering of the flank 4. The amount of heat introduced in this step is controlled constantly in order to obtain uniform bending across the length of the profiled edge 1. An exact alignment of the material after the partial tempering is possible only then.

The continuous plant shown in FIG. 6 for the additional partial tempering of the flank 4 has two—for example water-cooled—cooling boxes 10*a* and 10*b*, which between each other leave free a passage opening 11, of which the cross sectional shape is adapted to the cross sectional shape of the head 2. The cooling surfaces of the passage opening 11 rest against the head 3 from three sides and leave the flank 4 free, i.e., uncooled.

A heating device 12 is associated with the section of flank 4 that remains uncooled. Said heating device 12 may be an exactly controllable gas burner, an induction coil or a heating radiator, in particular a laser radiator. Possible is also conductive heating, for example heating in a suitably screened metal bath, or by means of a heating body that is brought into contact with the flank 4 of the profiled edge 1.

FIG. 6, furthermore, shows that the passage opening 11 is shaped in such a way that the transition zone 4*a* between the head 2 and the flank 4 is cooled as well. This produces between the head 2—which remains hard—and the additionally tempered flank 4 a transition zone 4*a* whose hardness is between the hardness of the head 2 and the one of the flank 4. The continuous feed rate v of the profiled edge 1 and the thermal feed Q by the heating device 12 are adapted to each other in such a way that the heating temperature and the duration of heating—and thus the formation of a pearlitic structure in the flank 4—are kept constant across the length of the profiled edge 1.

The continuous plant 9 for the additional partial tempering of the flank 4, furthermore, has a device 13 connected downstream for the gradual and controlled cooling of the flank 4.

The finished, heat-treated profiled edge 1 is subsequently subjected in a bending device 14 to a bending deformation, in which the flank 4 is stretched by a uniform amount. The uniform curvature of the profiled edge 1 forming during the partial heating of the inner edge part is cancelled by said bending deformation.

Finally, the finished, heat-treated and straightened profiled edge 1 is provided in a punching plant 15 with the recesses 5 and/or openings 6. This process is carried out either immediately after the heat treatment or, if need be, in another manufacturing location, for example in the manufacturing plant of the ski manufacturer. Since the flank 4 provided with the recesses 5 or openings 6 has only a low hardness, the tool wear in this punching process is very low.

The plant components shown schematically in FIG. 5 may be installed in a manufacturing plant in a continuous manufacturing line. However, they may be used also in different manufacturing locations, as symbolized in FIG. 5 by the parallel separation lines in the process sequence arrows.

I claim:

1. Process for producing a ski profiled edge made of quenched and tempered steel, said profiled edge having a head having the running surface and a flank projecting into the body of the ski, said flank being designed thinner than the head and being provided across its length with a great number of punched recesses and openings, with the subsequently specified, successive process steps:

(a) rolling or drawing of the profiled edge;

(b) quenching and tempering of the entire profiled edge by heating to the hardening temperature and subsequent tempering;

(c) partial heating of the flank to a temperature higher than the tempering temperature with simultaneous cooling of the head;

(d) punching of the recesses and openings in the flank;

wherein the improvement comprises, in that during quenching and tempering of the entire profiled edge (1), the deviation in Rockwell hardness seen in the direction of the cross section and the length of the profiled edge (1) is adjusted to less than 2° HRC; that the heating temperature and the duration of heating during the partial heating of the flank (4) are kept constant across the length of the profiled edge (1), and that after the partial heating and prior to the punching, the profiled edge (1) is subjected to a constant bending deformation, in which the flank (4) is stretched by a constant amount.

2. Process according to claim 1, characterized in that during the quenching and tempering of the entire profiled edge (1), a multi-step continuous quenching and tempering is carried out, in which the profiled edge (1) is first abruptly cooled in a continous metal bath to a temperature just above the martensite starting temperature (Ms), a change in structure of the austenitic structure formed during the abrupt cooling into the martensitic structure is subsequently carried out with gradual cooling under an air shower, and a tempering treatment is finally carried out under protective gas.

3. Process according to claim 1, characterized in that the abrupt cooling is carried out in a lead-bismuth continuous bath (8*a*) with a constant temperature particularly of 350° C.

4. Process according to claim 1, characterized in that the quenching and tempering of the entire profiled edge (1) takes place to a Rockwell hardness of 50° to 60° HRC, and that the hardness of the flank (4) is reduced by partial heating to 30° to 40° HRC.

* * * * *